US008104460B2

(12) United States Patent
Ribi

(10) Patent No.: US 8,104,460 B2
(45) Date of Patent: Jan. 31, 2012

(54) SPORT BOW AND CROSSBOW, WITH ONE OR BOTH LIMBS ELASTICALLY DEFORMING BY DEFLECTION OR SIMULTANEOUS DEFLECTION AND BENDING

(76) Inventor: Guido Ribi, Troistorrents (CH)

( * ) Notice: Subject to any disclaimer, the term of this patent is extended or adjusted under 35 U.S.C. 154(b) by 618 days.

(21) Appl. No.: 12/094,776

(22) PCT Filed: Nov. 27, 2006

(86) PCT No.: PCT/EP2006/068921
§ 371 (c)(1),
(2), (4) Date: Sep. 5, 2008

(87) PCT Pub. No.: WO2007/060231
PCT Pub. Date: May 31, 2007

(65) Prior Publication Data

US 2009/0314271 A1 Dec. 24, 2009

(30) Foreign Application Priority Data

Nov. 28, 2005 (CH) ..... 1955/05

(51) Int. Cl.
*F41B 5/00* (2006.01)
*F41B 5/12* (2006.01)

(52) U.S. Cl. ..... 124/23.1; 124/25; 124/25.6

(58) Field of Classification Search ..... 124/23.1, 124/25.6, 86, 25
See application file for complete search history.

(56) References Cited

U.S. PATENT DOCUMENTS

| | | | | |
|---|---|---|---|---|
| 3,993,039 | A | 11/1976 | Groves et al. | |
| 4,078,537 | A | 3/1978 | Carella | |
| 4,207,859 | A | 6/1980 | Scholten | |
| 4,227,509 | A | 10/1980 | Jones | |
| 4,955,354 | A | 9/1990 | Bozek | |
| 5,408,982 | A | 4/1995 | Doornenbal | |
| 5,638,804 | A | 6/1997 | Remick et al. | |
| 5,967,132 | A | 10/1999 | Loomis | |
| 6,067,974 | A | 5/2000 | Islas | |
| 6,634,347 | B2 * | 10/2003 | Holler | 124/23.1 |
| 6,792,931 | B1 * | 9/2004 | Schaar | 124/25.6 |

* cited by examiner

*Primary Examiner* — John Ricci

(57) ABSTRACT

Bows and crossbows having two limbs, of which at least one limb (4*a*, 4*c* or 36*a*) can elastically deform by deflection or simultaneous deflection and bending thanks to the synergy of the draw on the string (10) and on auxiliary cables (7) secured at the ends (4*ad*, 4*cd* or 36*ad*) of the limbs (4*a*, 4*c* or 36*a*) and to anchors (8, 41) on the heads of the riser (1) or the stock (33).

23 Claims, 14 Drawing Sheets

SPORT BOW AND CROSSBOW, WITH ONE OR BOTH LIMBS ELASTICALLY DEFORMING BY DEFLECTION OR SIMULTANEOUS DEFLECTION AND BENDING

BACKGROUND OF THE INVENTION

The bow according to the present invention is an archery bow having the same functional features, or at least the same behavior during the draw, as most "compound" bows.

Compound bows essentially allow draw force on the string to vary during the draw, and especially provide a weight reduction at full draw let-off as compared with the peak draw weight for easy aiming, wherefore they can enhance shooting dynamics, and further provide the advantage of accumulating more elastic energy for a given maximum draw force.

Many attempts have been made after H. W. Allen's invention, U.S. Pat. No. 3,486,495, issued in 1969, which uses eccentric pulleys, possibly in multiple arrangements. Most of the solutions provided heretofore have often used such pulleys or cams, except a few of them, such as those proposed by L. Roger Loomis, U.S. Pat. No. 5,967,132, issued in 1998, by Mc Pherson, Mathew A., U.S. Pat. No. 5,368,006, issued in 1992, by Islas, John, U.S. Pat. No. 6,067,974 and by Mc Pherson Mathew A., U.S. Pat. No. 6,237,582. issued in 2000.

Such improvements only provided variants, although well-conceived, of the same arrangements, which have sometimes produced excellent practical results, while consistently having three major drawbacks: The first drawback is the weight of the bow, which is never below four pounds, the second is its size and the third is the impossibility of quickly disassembling the bow without using special equipment.

Now, the present bow obviates these drawbacks thanks to the use of a wholly different mechanical concept for elastic deformation of the limbs, which also has the advantage of allowing variations of the draw force $F_D$ during the draw, i.e. of obtaining the same draw force curve DFC as traditional compound bows.

Figure 1A:
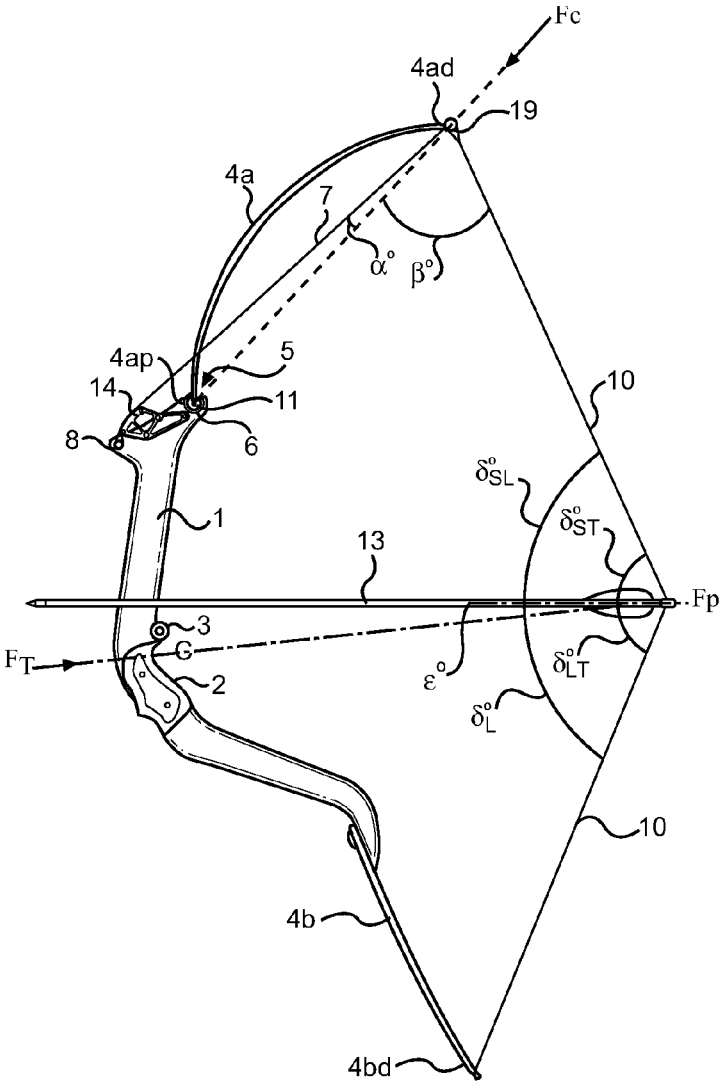
Figure 1B:
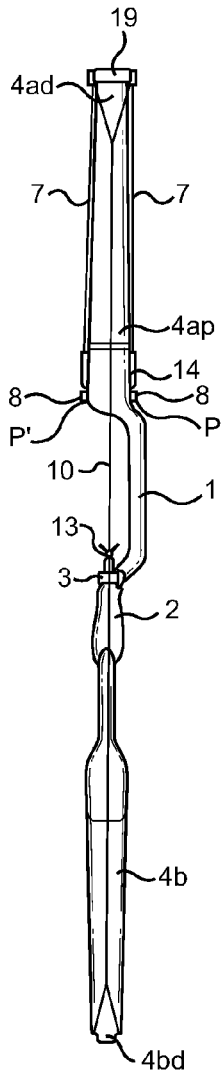

The features and the advantages of the bow according to the present invention which are disclosed in the annexed claims and sub claim will appear with greater detail from the following description of some embodiments which are illustrated in the annexed drawings according to the following list:

FIG. 1. Bow (claim 1) with cylinders 6 (claim 6) with cams 14 (claim 7) and tip cylinder 19 (claim 11). Angle ϵ between FD and Fp is shown.

Figure 2A:
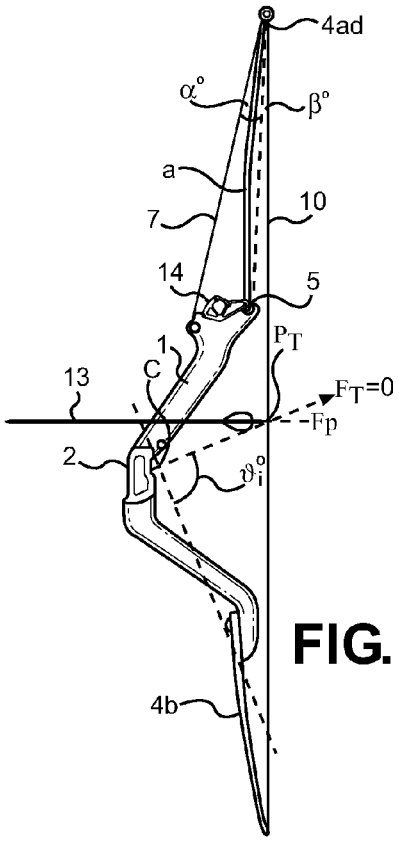
Figure 2B:
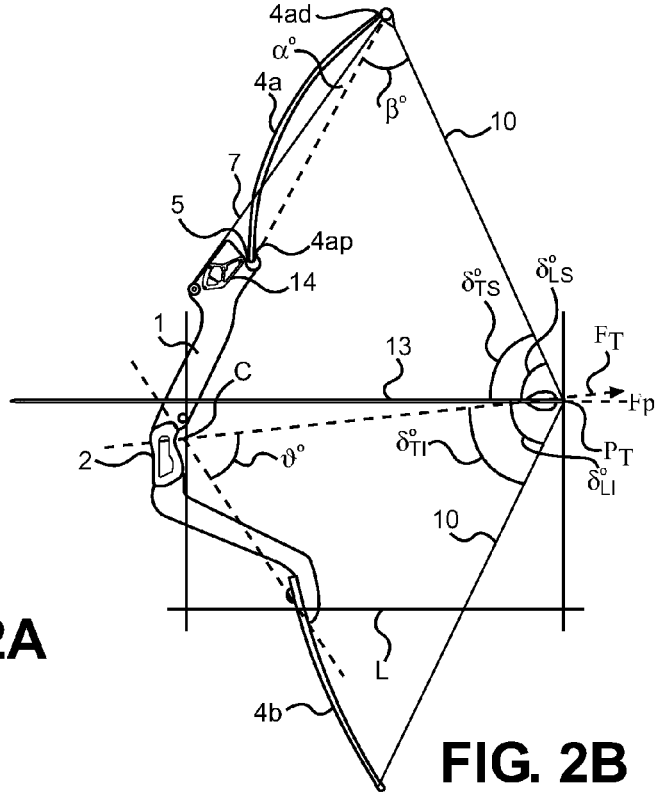
Figure 2C:
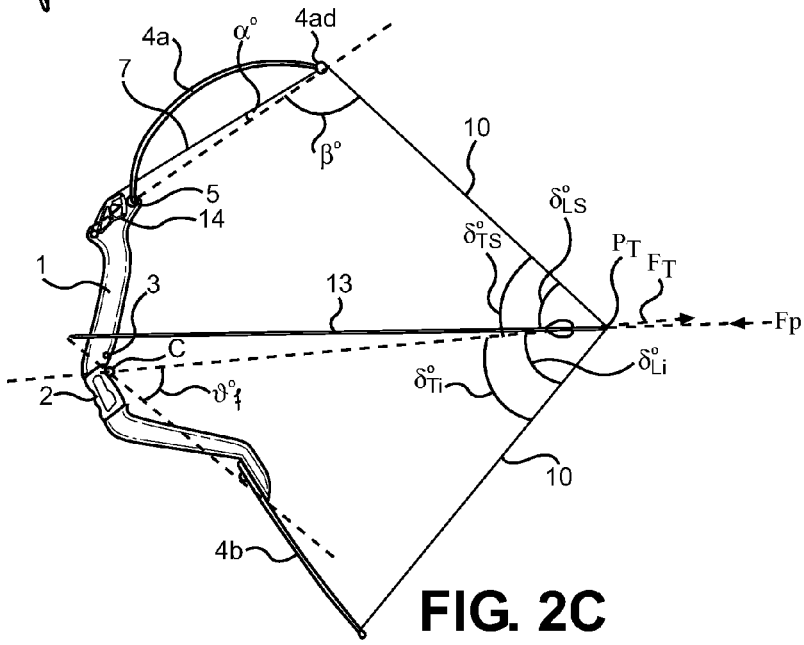

FIG. 2. Bow (claim 1) in three successive draw steps. The rotation angle i-. f is shown.

Figure 3A:
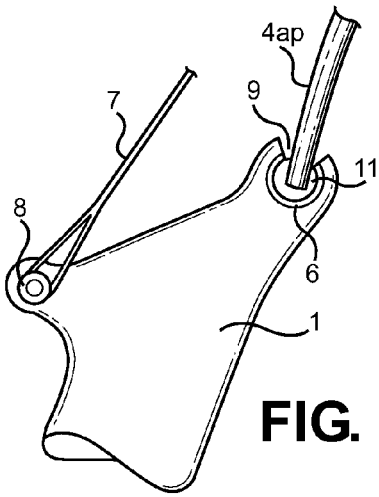
Figure 3B:
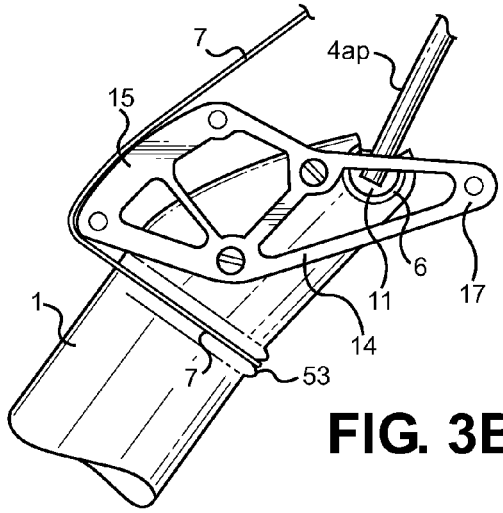

FIG. 3. Details of the head of riser 1. a) without cams 14, b) with cams 14 (claim 7), single auxiliary cable 7 (claim 8), slit 53 and supports 17 (claim 9).

Figure 4A:
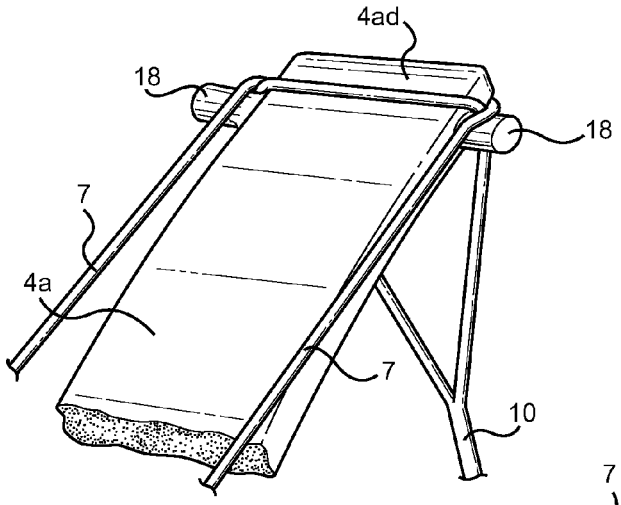
Figure 4B:
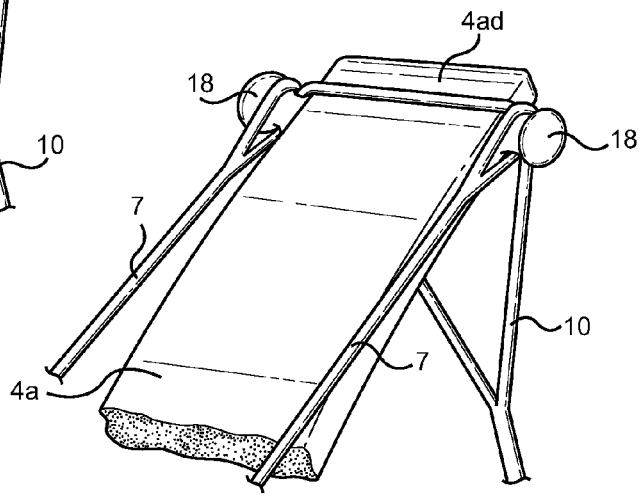

FIG. 4. Details of the head of riser 1 with rigid extensions 18 (claim 10) with a single auxiliary cable 7 and b) with auxiliary cables 7 with loops.

Figure 5:
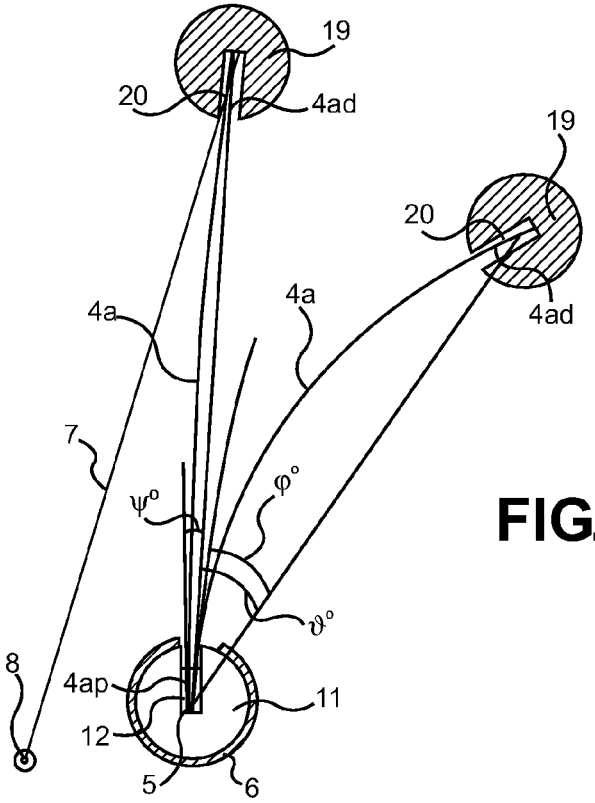

FIG. 5. Rotation angles in receptacle 5°, and °(claim 6).

Figure 6A:
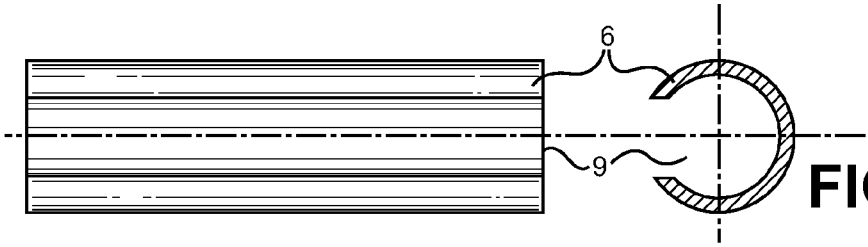
Figure 6B:
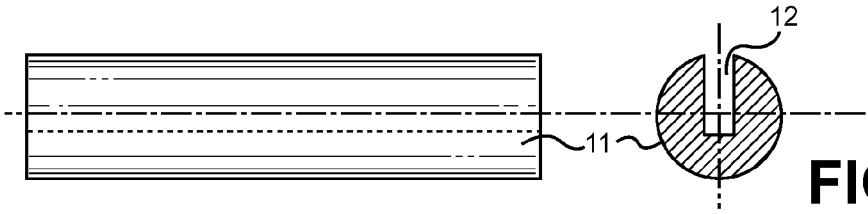
Figure 6C:
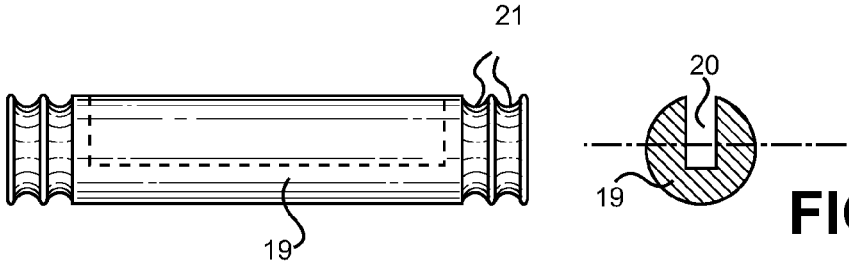

FIG. 6. Details: a) cylinders 6 and b) cylinder 11 (claim 6) and c) tip cylinder 19 (claim 11)

Figure 7:
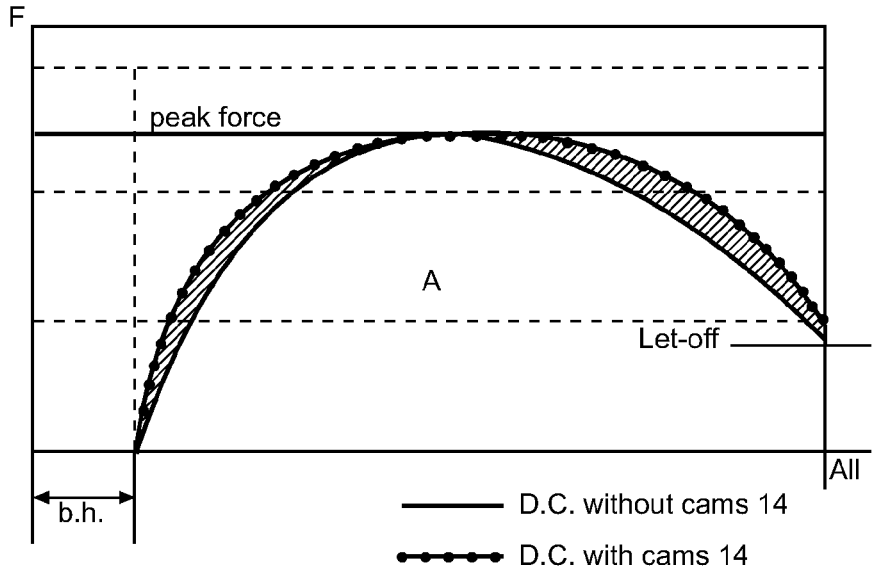

FIG. 7. General draw force curve DC with b.h.=brace height and let-off, and hatched surface=increase of accumulated energy thanks to the cams 14.

Figure 8:
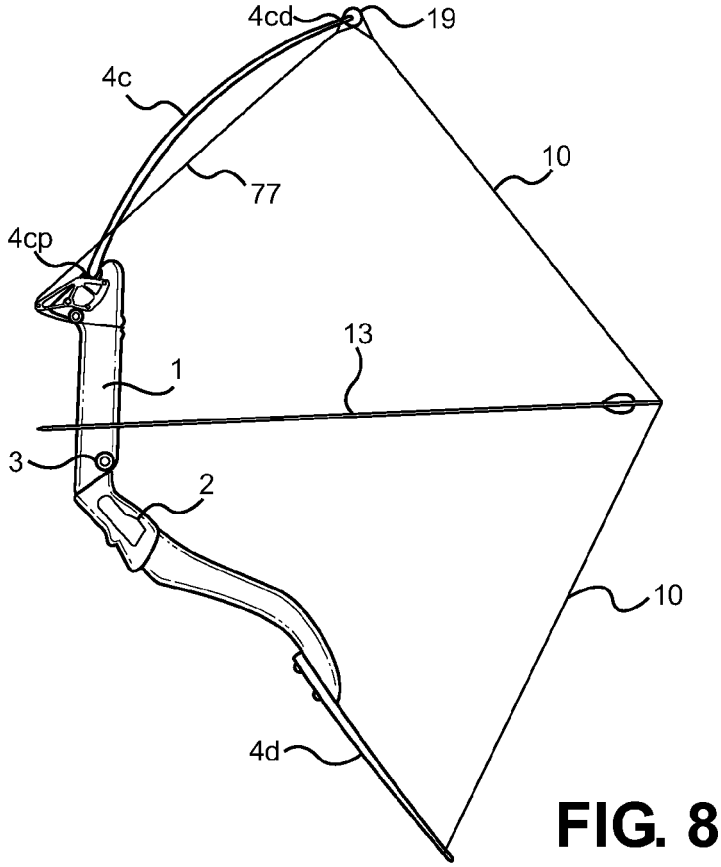

FIG. 8. Bow (claim 17) with one simultaneously deflecting and bending limb 4*c*. The fixation point is shown at 4*cp*.

Figure 9A:
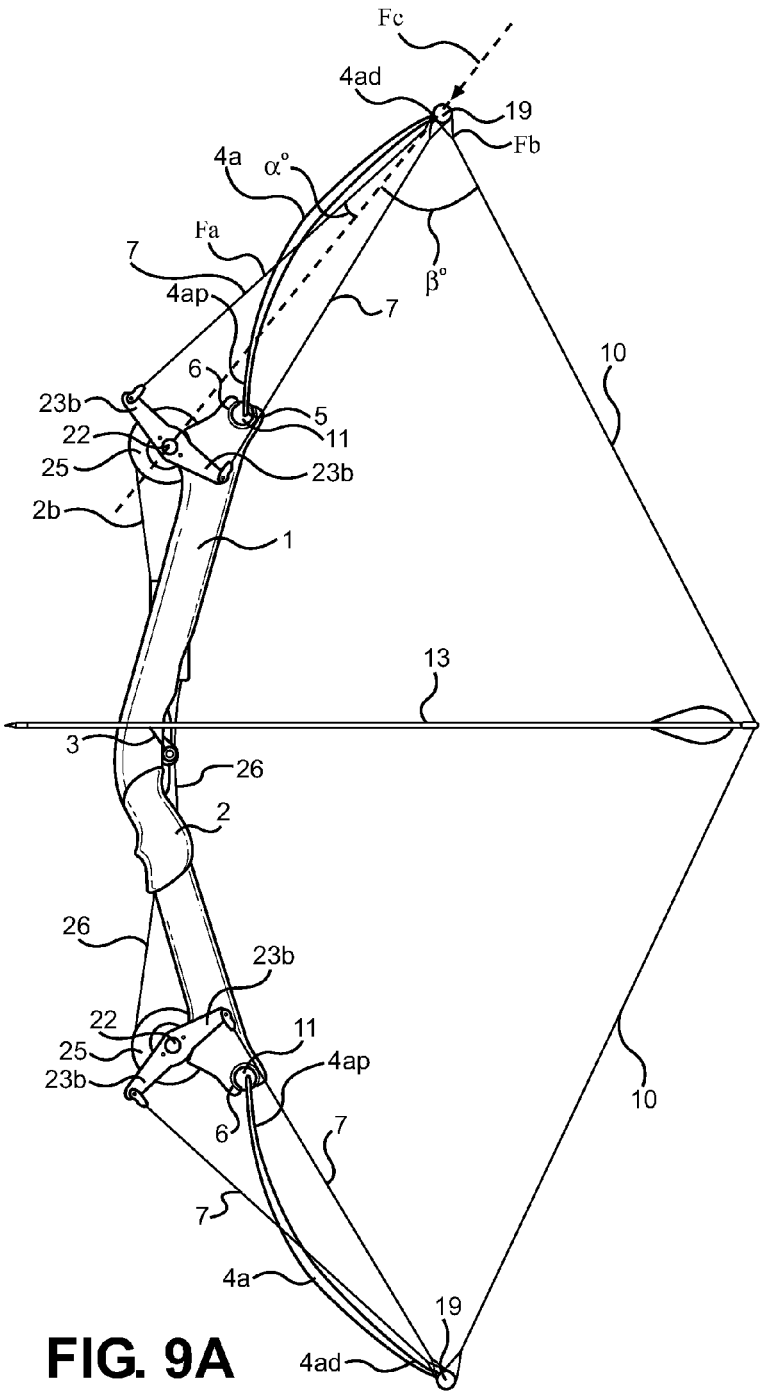
Figure 9B:
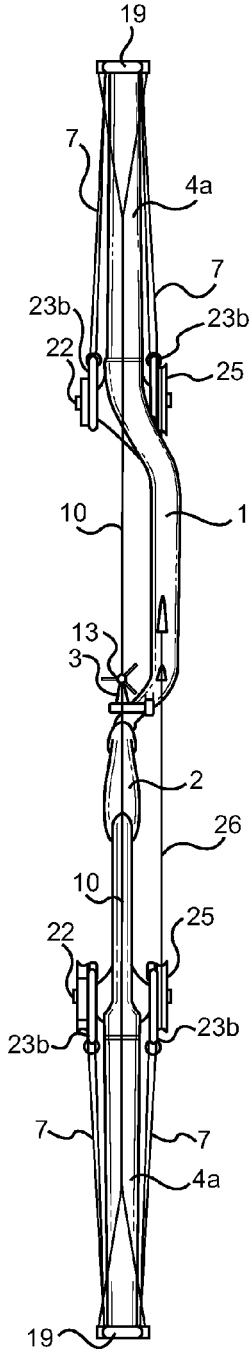

FIGS. 9A and 9B. Bow (claim 13), seen in side and front views, with arms 23*b* replacing the pulleys 23, with cable 26 formed in a figure-eight shape.

Figure 10A:
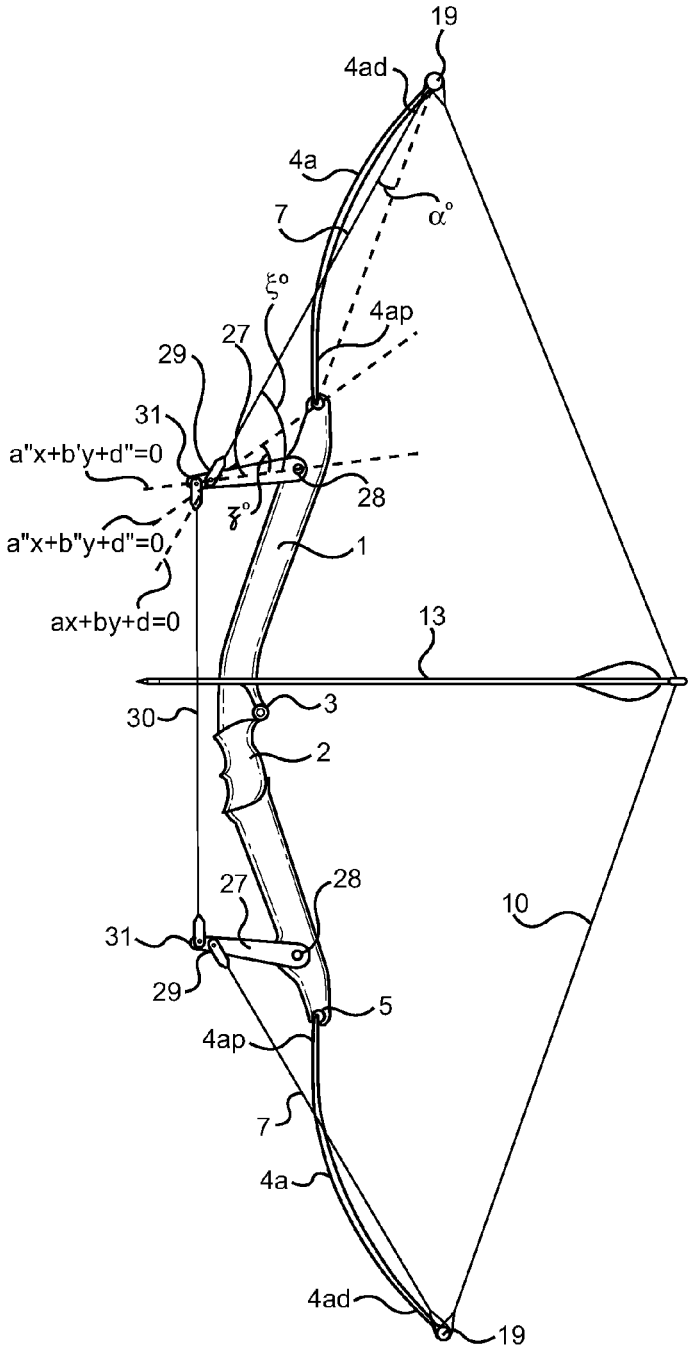
Figure 10B:
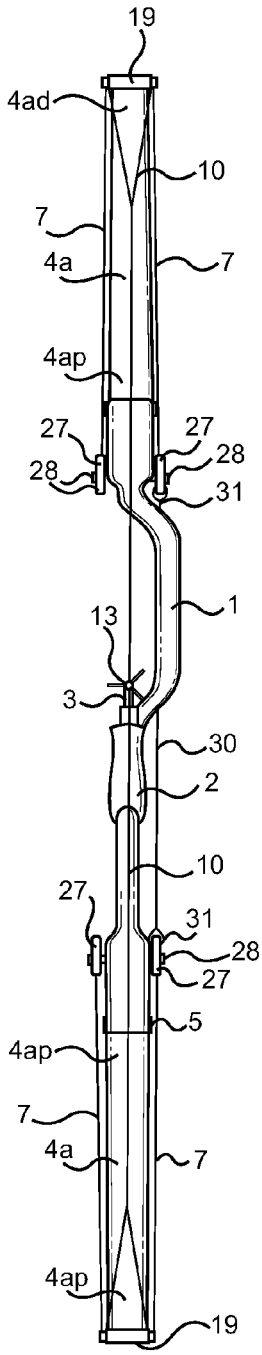

FIG. 10. Bow (claim 15) with arms 27 swinging under compressive stress, with the return cable 30 directly secured to the arms 27.

Figure 11A:
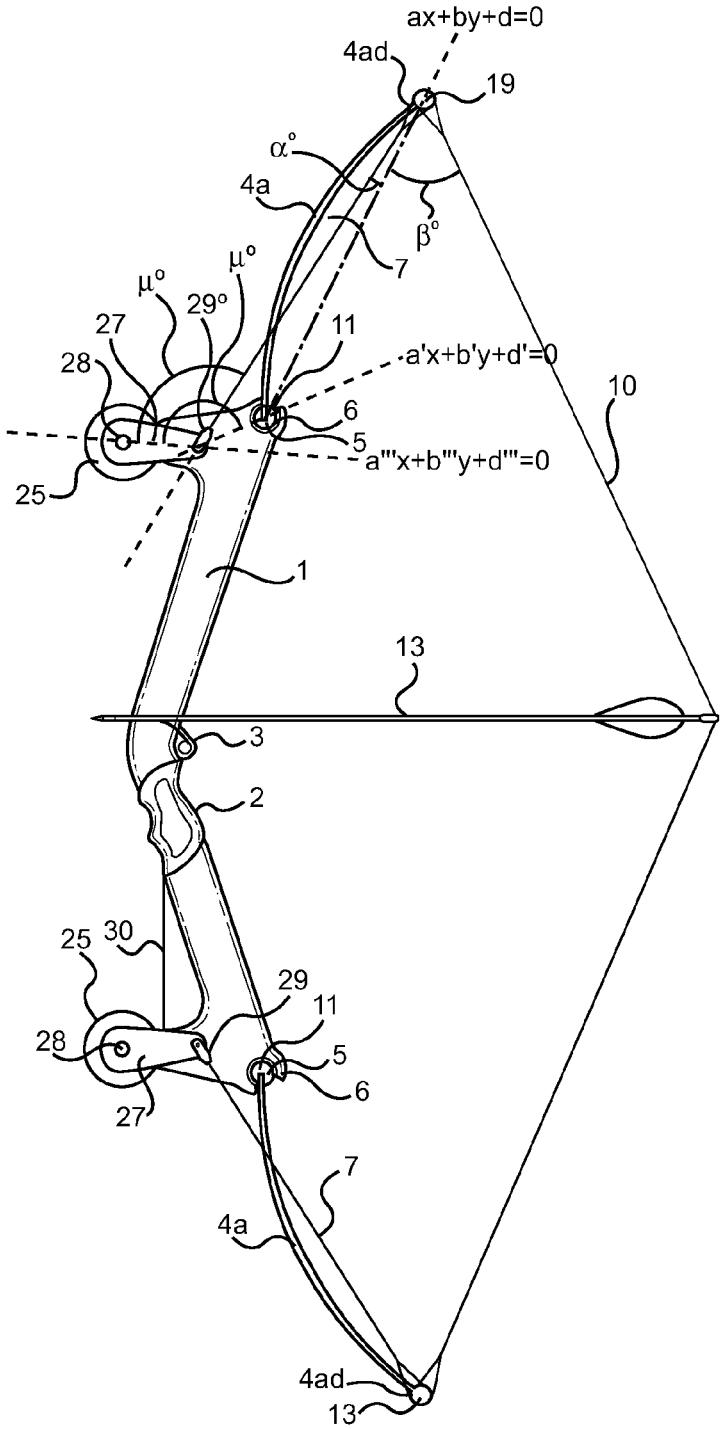
Figure 11B:
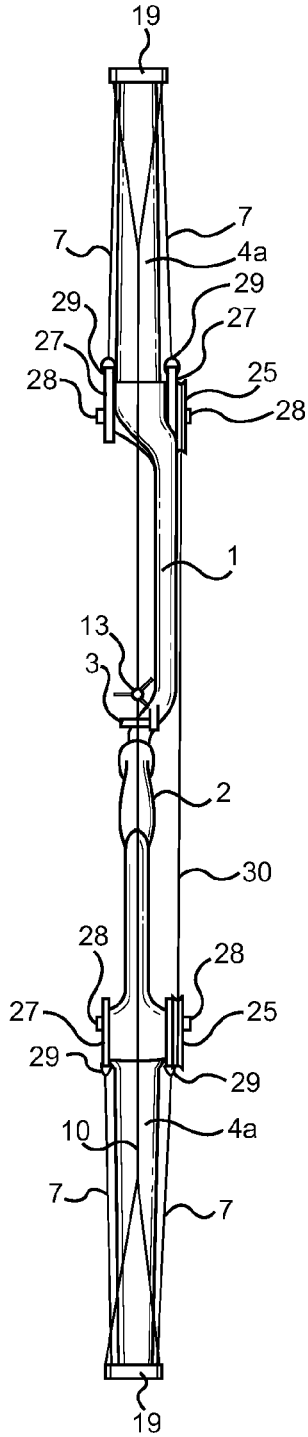

FIGS. 11A and 11B. Side and front views of a bow (claim 16) with arms 27 swinging under tensile stress with the return cable 30 secured to pulleys 25.

Figure 11C:
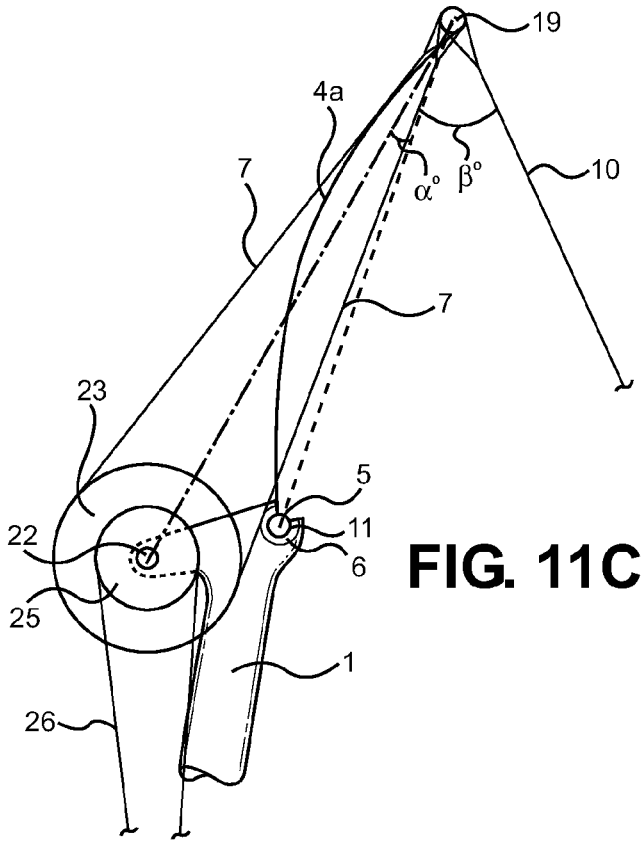
Figure 11D:
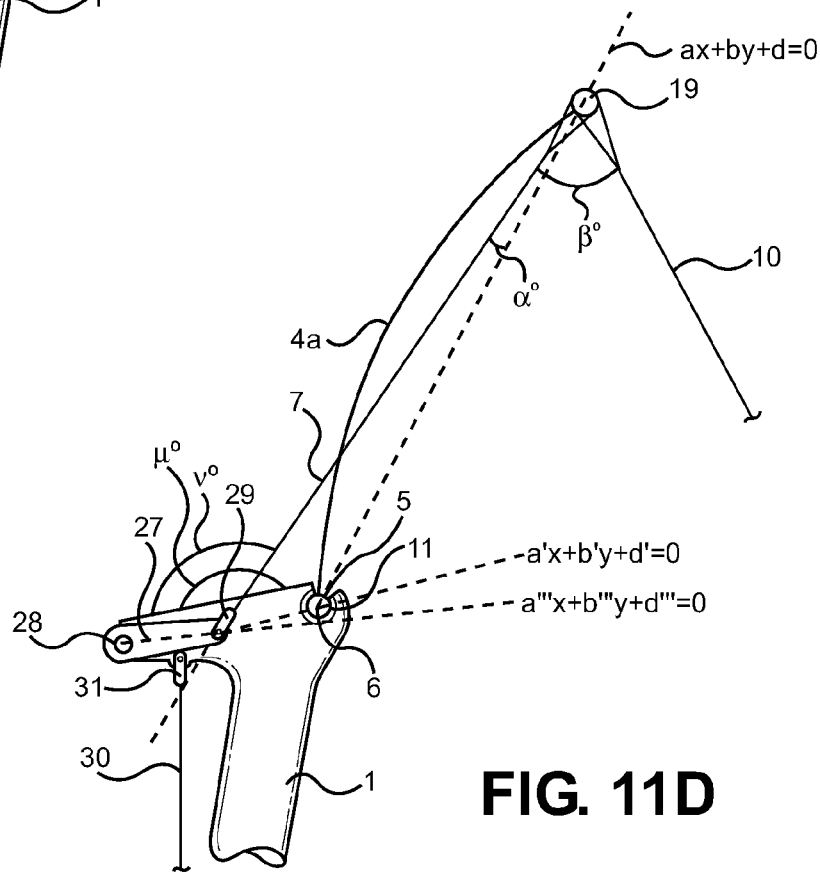

FIGS. 11C and 11D. Detail of riser heads as set out in claim 16.

Figure 12A:
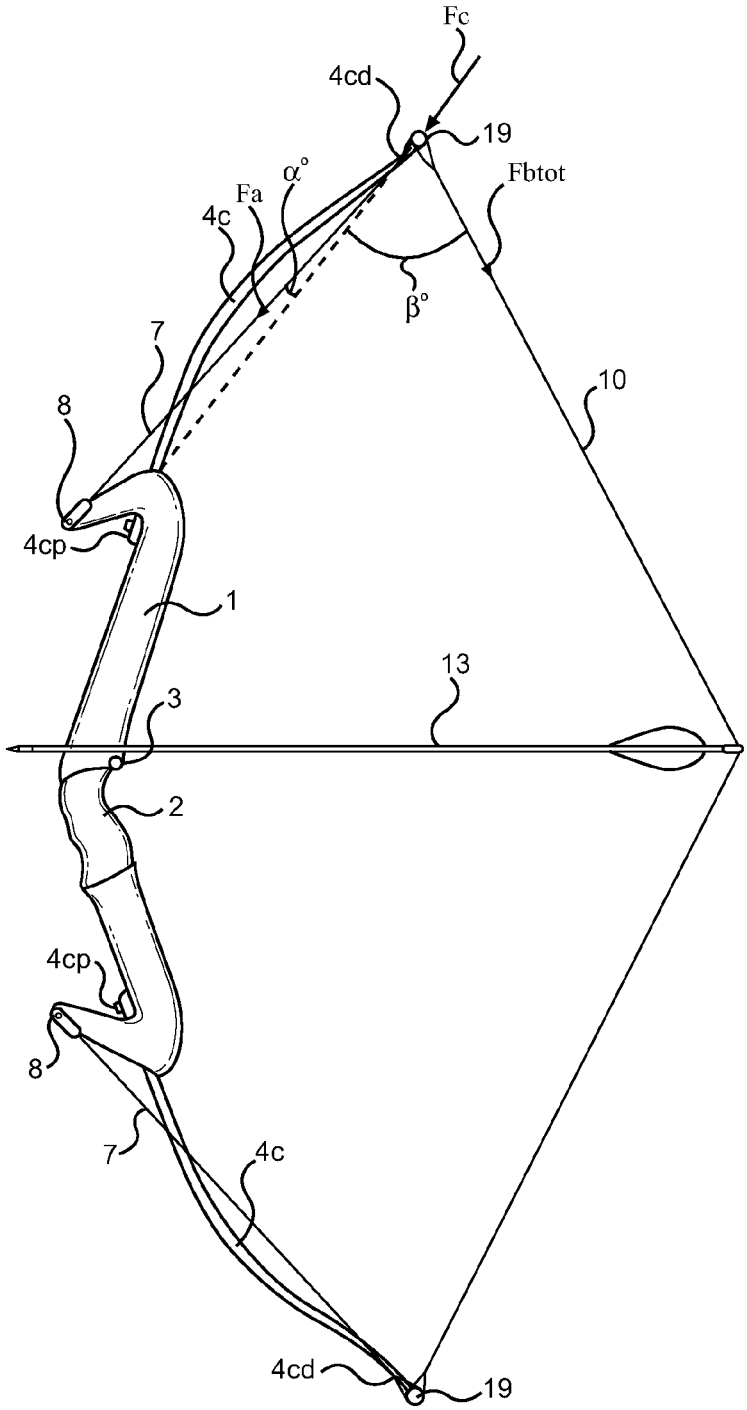
Figure 12B:
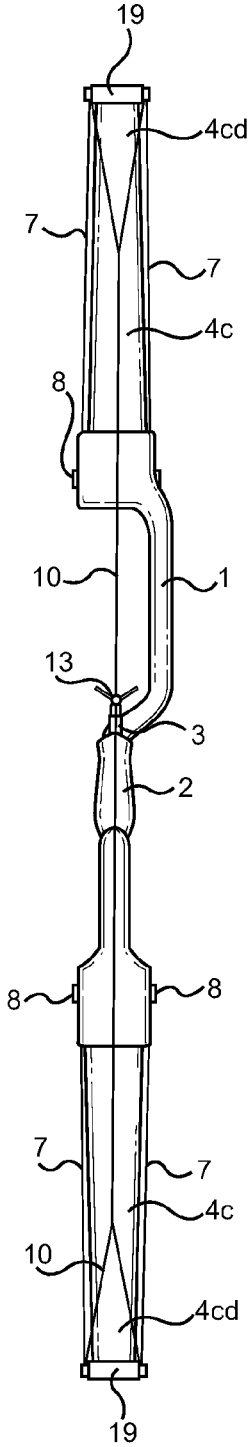
Figure 13A:
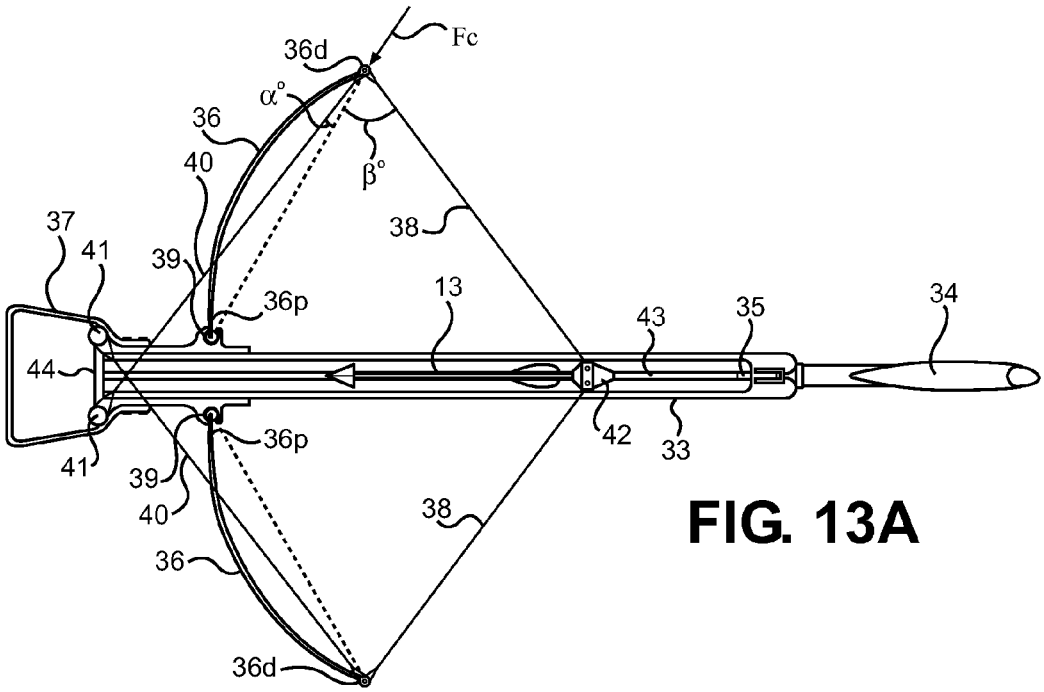
Figure 13B:
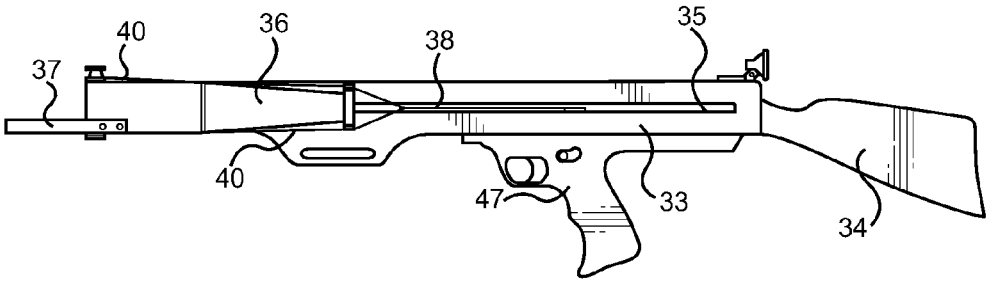
Figure 13C:
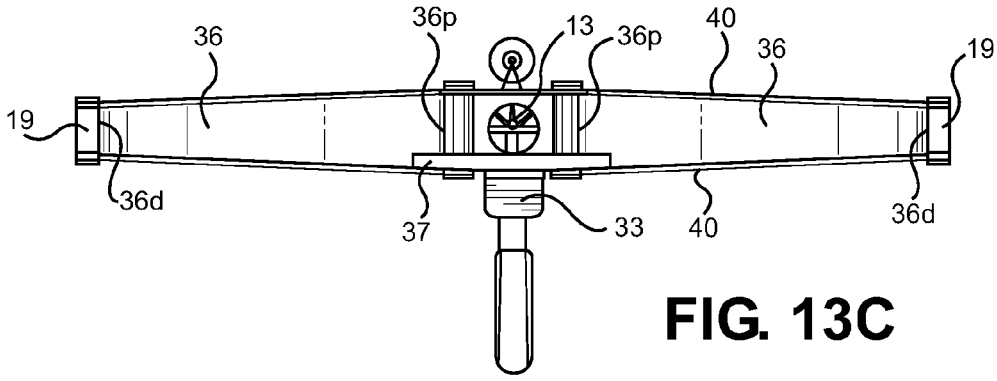
Figure 13D:
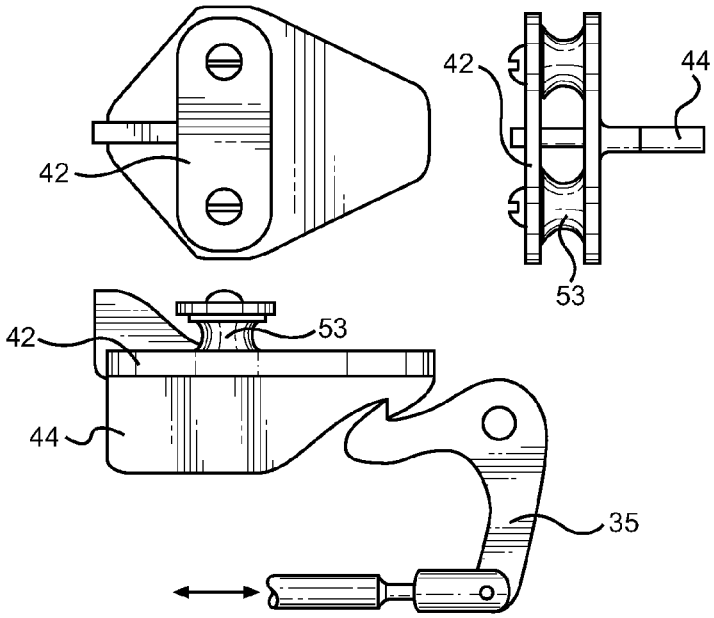
Figure 13E:
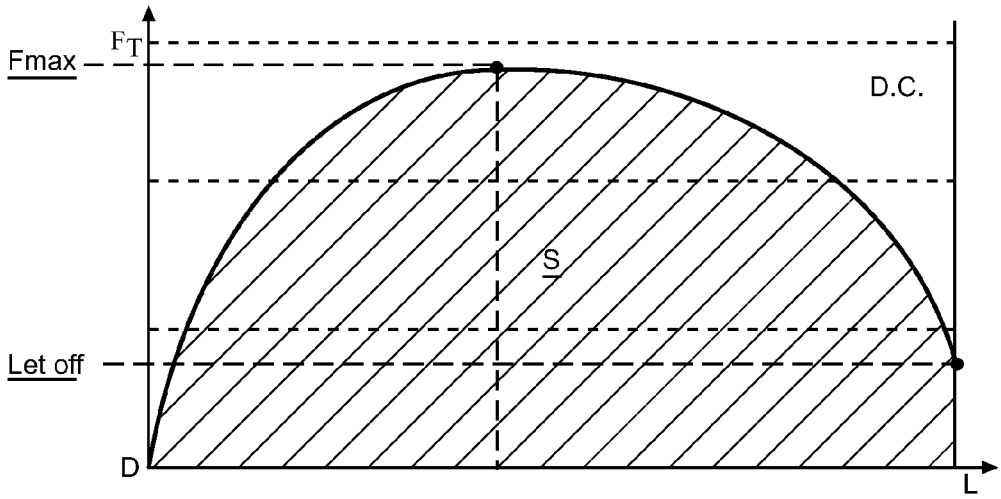
Figure 14A:
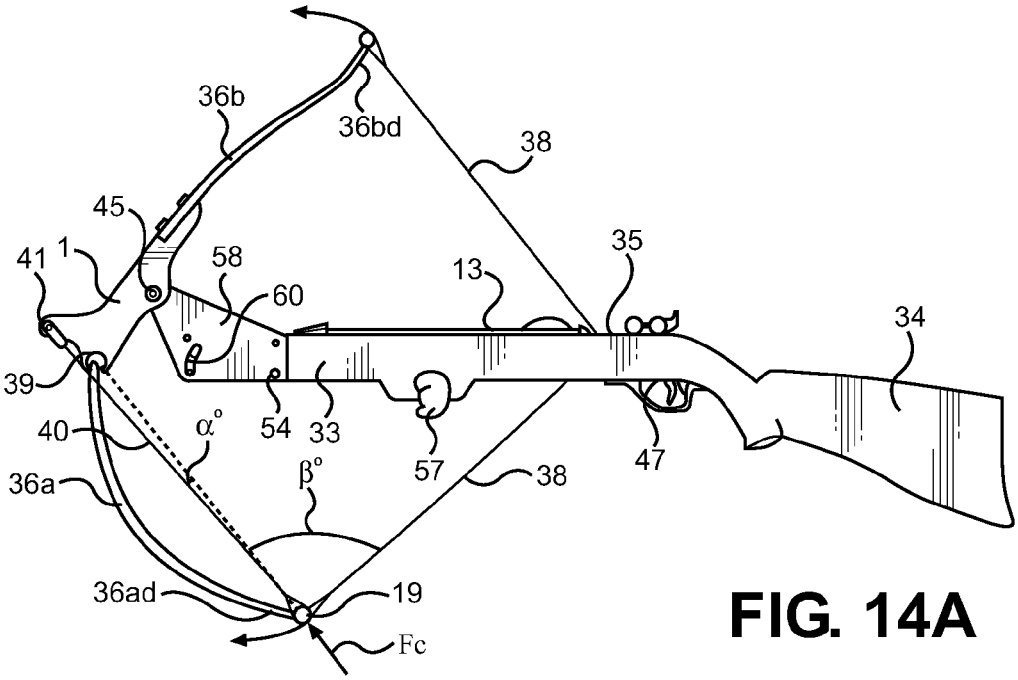
Figure 14B:
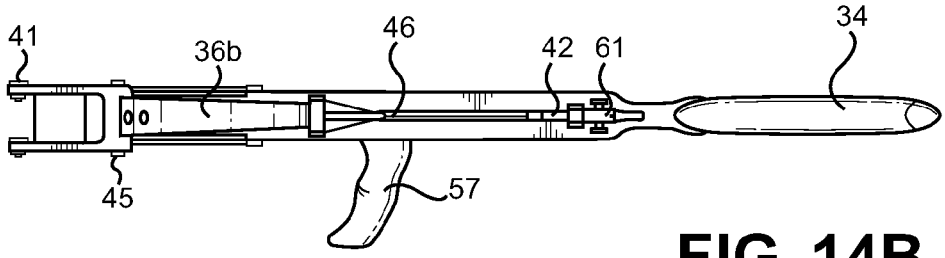
Figure 14C:
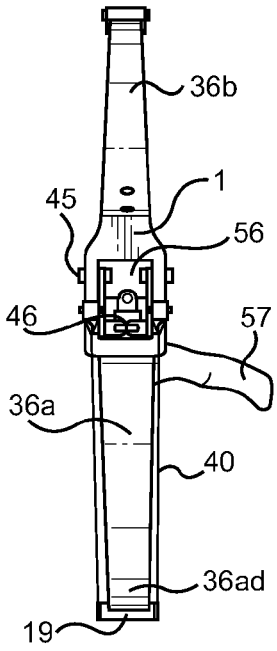
Figure 14D:
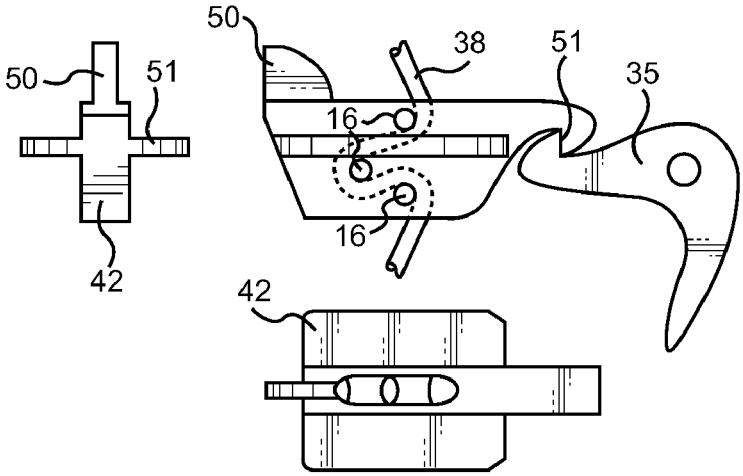
Figure 14E:
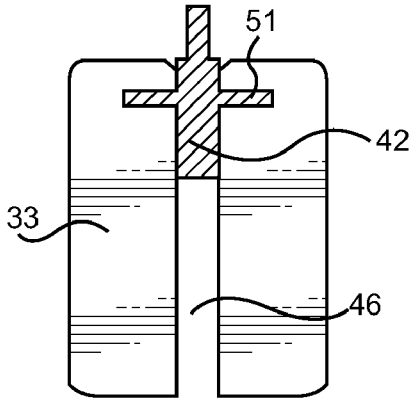
Figure 14F:
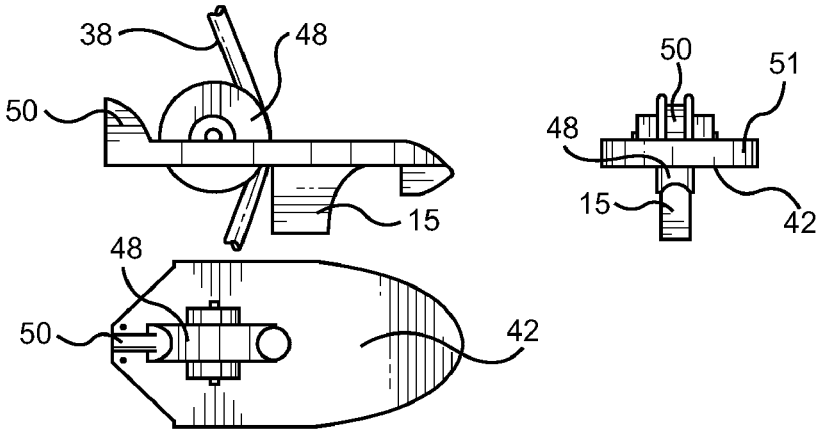

FIG. 12. Bow (claim 17) with two simultaneously deflecting and bending limbs. The fixation points of limbs 4*c* are shown at 4*cp*.

FIG. 13. Crossbow (claim 19) with rotation plane of limbs 36 and string 38 inside the stock 33 and parallel to the axis of arrow 13.

FIGS. 14A-14F. Crossbow and details thereof according to an embodiment of the invention.

DETAILED DESCRIPTION OF THE EMBODIMENTS

The bow of the present invention utilizes a dynamic synergy of the draw fb exerted along sections of the string 10 connected to the tips 4*ad* of the limbs 4*a* and the draws ff, induced by fb thanks to the elastic reaction of the limbs 4*a* or 4*c* along the lines connecting their tips 4*ad*-4*ap* or 4*cd*-4*cp*, by means of auxiliary cables 7 connected to the tips 4*ad* or 4*cd* of the limbs 4*a* or 4*c* and to anchorages 8 at the ends of the riser 1. These forces fb and ff exerted on the limb tip 4*ad* generate a resultant compressive force Fc causing deflection of the limbs 4*a*, which are inserted or hold or fitted and articulated or hinged against receptacles 5, also located at the ends of the riser 1. Nevertheless, when the cable (7) or the string (10) are connected to sections of the longitudinal extension of the limbs (4*a*) closer to the base (4*ap*) then to the tip (4*ad*), a resultant compressive force F'c≠ Fc may be obtained, which will also cause deflection of the limb/s (4*a*) (see claim 2 and FIG. 8).

This bow (see FIG. 1) may be also designed with one deflecting limb 4*a*, whereas the other limb is restrained like in a traditional bow.

This configuration is particularly advantageous in that it allows a larger amount of energy to be transferred to the arrow 13, thereby providing very high performances. Also, this bow makes no use of pulleys or cables between the string and the grip.

The geometry and construction features of the bow provide efficient draw force curves DFC and balanced shooting dynamics, with optimized let-offs, the better suited to the specific use of the arrow, as well as the possibility of manually disassembling the bow in a few seconds. The operating principle based on deflection, using the auxiliary cables 7, applies both to inserted or hold or fitted and articulated or hinged limbs 4*a* and to restrained limbs 4*c* (see claim 17).

Features and Operation of the Bow

The limb/s 4*a* that are only susceptible to deflection are not restrained, but only inserted or hold or fitted and articulated or hinged by their base 4*ap* against receptacles 5 formed in various equivalent manners at the ends of the riser 1. Therefore, these limbs 4*a* can rotate, while being deflected, about the axes of said receptacles 5, which are perpendicular to the principal plane (x,y) of the bow.

For the limbs 4*a* to be deflected against such receptacles 5, the compressive forces Fc are exerted along the lines connecting the ends 4*ad* and 4*ap* of the limbs 4*a* and are generated by the synergy of the forces fb and fa, resulting from the forces ff exerted on the tips 4*ad*.

Under equilibrium conditions, these forces are:

a) The draw forces fb along the sections of the string 10;

b) the forces ff induced thanks to the elastic reactions of the limbs 4*a* by the forces fb, along two auxiliary cables 7 for each limb 4*a*, both lying on generic planes ax+by +d=0. These cables 7 are connected to the tips 4*ad* of the limbs 4*a* and to two anchorages 8 for each limb, which are disposed symmetrically on each side of the plane (x, y) and on a side opposite to the string 10 with respect to a plane perpendicular to the plane (x,y) containing the alignment of the two ends 4*ad* and 4*ap* of the limbs.

Thus, under equilibrium conditions, each compressive force Fc, exerted along the alignment 4*ad* and 4*ap* of each limb 4*a* is always the resultant of two forces: the force $\vec{fb}$ and the force $\vec{fb}$, which is the resultant of the forces ff on the plane x,y, whose relation to $\vec{Fc}$ is as follows:

$$\vec{Fc} = \sqrt{\vec{fa}^2 + \vec{fb}^2 + 2\vec{fa}\cdot\vec{fb}\cdot\cos(\alpha^\circ + \beta^\circ)}$$

Where α°=angle between the vector $\vec{fa}$ and the alignment between the two tips 4*ad* and 4*ap* of each limb 4*a;*

β°=angle between the alignment of the two tips 4*ad* and 4 *ap* of each limb 4*a* and the section of the string 10.

From this geometry, the following relations are further easily determined:

$$\vec{fa} = \vec{Fc}\cdot\frac{\sin\beta^\circ}{\sin(\alpha^\circ + \beta^\circ)};\ \vec{fb} = \vec{Fc}\cdot\frac{\sin\alpha^\circ}{\sin(\alpha^\circ + \beta^\circ)}$$

as well as $\vec{fb}\cdot\sin\beta^\circ = \vec{fa}\cdot\sin\alpha^\circ$ which influences equilibrium.

Draw Force Values $D_F$

Draw Force Curves DC

For bow optimization, once the moduli of vectors $\vec{fb}_{up}$ and $\vec{fb}_{low}$ are determined, it is possible to geometrically determine, for each draw position, the angles $\delta^\circ_{up}$ and $\delta^\circ_{low}$ between the upper and lower sections of the string 10 and the alignment of $\vec{F_D}$ between the nock of the arrow 13 on the string 10 and the center of contact between the hand and the grip 2.

Therefore, the total draw force will be:

$$\vec{F_D} = \vec{fb_{up}}\cdot\cos\beta^\circ_{up} + \vec{fb_{low}}\cdot\cos\beta^\circ_{inf}$$

Where necessarily:

$$\vec{fb_{low}} = \vec{fb_{up}}\cdot\sin\alpha^\circ_{up}/\sin\alpha^\circ_{low}$$

The $F_D$ values, when reported in a draw force curve DC, where the x-coordinate represents the draw length and the y-coordinate represents the draw force, will delimit as usual an area A representing the accumulated elastic energy.

It will be incidentally recalled that, during the shot, the angles $\delta^\circ_{up}$ and $\delta^\circ_{low}$, between the sections of the string 10 and the axis of the arrow 13, vary.

The various possible positions of the receptacles 5, the anchorages 8, the auxiliary cables 7, the tips of the bending limbs 4*b*, if any, the tips 4*ad* of the deflecting limbs 4*a*, the length of the string 10 and the length of the bow will give, in various combinations, a corresponding number of draw force curves, which will be selected according to the desired performances, not only for their ability of accumulating the largest amount of energy for maximum $F_D$ values, but also in view of optimizing bow dynamics, and hence the direction of the arrow 13 during the shot.

This bow, particularly in the preferred embodiment (see FIG. 1) with one limb 4*a* designed for deflection, as better described hereafter, under proper dynamic equilibrium conditions (generally not corresponding to a maximum value of accumulated energy), may not require the use of mass compensators or stabilizers around the principal axes of inertia, i.e. the pitch axis (z), the roll axis (x) and the yaw axis (y), and will be a particularly stable and balanced archery bow.

A further improvement of the draw force curve DC may be achieved using two static cams 14 (see FIGS. 1 and 3*b*) for each limb 4*a*, which have the function of changing the angle α° between the vector $\vec{fa}$ resulting from the forces ff exerted along the auxiliary cables 7 and the alignment of the tips 4*ad* and the bases 4*ap*, i.e. the vector $\vec{Fc}$, thereby also changing the modulus and direction of the vector $\vec{fa}$ and consequently the modulus of the vector $\vec{fb}$.

These cams 14, having a grooved 16 profile 15, intercept the auxiliary cables 7 while rotating in response to the deflection of the limbs 4*a*, thereby maintaining or delaying the reduction of the angle α° during the draw $F_D$, wherefore the force fb is stronger at the start and end portions of the draw force curve DC as shown in FIG. 7.

It shall be further considered that, as mentioned above, the changing gradient of the angle α° also causes changes in shooting dynamics.

A compromise between maximized accumulated energy and proper shooting dynamics is the main purpose of design optimization.

In this connection, since the bow has to be designed for a variety of draw lengths from 26' to 31', each of such draw lengths will require a specific optimization and possibly a specific profile 15 for the cam 14.

Concerning the rotation of the auxiliary cables 7, it will be appreciated that the resultant $\vec{fa}$ of their forces ff at full draw may form any angle α° as small as required with the alignment of the tips 4*ad* and the bases 4*ap* of the limbs 4*a*.

When the angle α° is 0°, the force fb along the section of the string 10 will also be 0. Two limit stops or supports 17 (see FIG. 3*b*) will be provided for intercepting the two auxiliary cables 7 by their two grooves, to prevent the angle α° from becoming negative. These limit stops may be also integrated in the cams 14 which are disposed symmetrically at each side of the relevant end of the riser 1 whereto the limb 4*a* is connected.

Deflection limbs 4*a* are different from secured limbs. In order that a maximized elastic energy may be concentrated in a minimized volume, the limb 4*a* has to be designed with second order moments of inertia $I^4$ in the various sections such that, at the maximum deflection, the admissible stress σ is as constant as possible along the extension of the limb 4*a*. Thus, the values of $I^4$ will be higher at the center of the limb 4*a* and progressively decrease towards its ends, which generally means that that with rectangular sections, the thickness of the limbs $$h = \sqrt[3]{\frac{I * 12}{b}}$$

will be higher than at the ends.

If this bow is designed in accordance with the above description, the draw force curve DC will be similar to that of FIG. 7. Considering the figure, the curve starts from abscissa $X_i$, corresponding to the brace height and ordinate y=0, then it increases to a maximum, wherefrom it decreases to full draw $X_m$ and at the limit to ordinate y=0, with $\alpha°=0$.

The draw length at let-off is generally selected to a value of 20% to 40% of the maximum $F_D$. Using cams 14, the curve may be enhanced in terms of energy accumulation. It will be appreciated that the $F_D$ values increase more rapidly, are longer constant and decrease more rapidly, thereby causing an increase of area A, i.e. of accumulated energy.

However, this excess of accumulated energy sometimes involves excessive variations of the angular momenta l*dω=Mi*dt=l*dw during the shot, which affect dynamic equilibrium and proper flight of the arrow 13.

Preferred Embodiment of the Bow

The bow that best embodies the features of the basic inventive principles (FIG. 1) comprises a riser 1 having a grip 2 and a rest for the arrow 13, a limb 4*b* restrained, in any suitable manner, in the lower end of the riser 1 and a limb 4*a*, only designed for deflection, which is hinged to the upper end of the riser 1 in a receptacle 5. Such receptacle 5 (see FIG. 3*a*) is a hollow cylinder 6, which is partially open along two of its generatrices, and is embedded in the riser end, a solid cylinder 11 rotating therein and having a longitudinal groove 12 in which the base 4*ap* of the limb 4*a* is fitted.

The string 10 joins the two distal ends 4*ad* and 4*ab* of the limbs 4*a* and 4*b*. Two auxiliary cables 7 are disposed symmetrically on each side of the limb 4*a*, and are attached on one side to two anchorages 8 located in such positions and arrangements as set out in claim 1 and on the other side to the tip 4*ad* of the limb 4*a* either though two rigid tip extensions 18 (see FIG. 4) by such attachment arrangements as set out in claim 10 or through a cylinder 19 (see FIG. 5) as set out in claim 11. The arrangement with two loops of the auxiliary cables 7 around the two outer annular grooves 21 allows quick assembly and disassembly of the main elements of the bow. Alternatively, in this arrangement, the receptacle 5 in which the limb 4*a* is inserted or hold or fitted and articulated may also simply be a groove having a rounded V-shaped bottom with generatrices perpendicular to the principal plane (x, y) of the bow. The rectangular aperture 9 formed in the hollow cylinder 6 and in the ends of the riser 1 that house the cylinder 6 is as long as the width of the base 4*ap* and as deep as the radius of the cylinder 6 multiplied by the angle $\phi°-\theta°+\psi°$.(see FIG. 5) plus the width of the longitudinal groove 12.

This bow may obviously have static cams 14 with grooves 16, as set out in claim 7, to obtain a more statically and dynamically efficient draw force curve, as well as supports 17 as set out in claim 9, which act as limit stops for the auxiliary cables 7.

The above described bow is an asymmetric bow having an asymmetric static and dynamic behavior. Such asymmetry may be dynamically used to obtain a high performance (energy of the arrow 13/total energy), approximating 80% with an optimal alignment of the axis of the arrow 13 with its initial barycentric path.

The bow will be now described with reference to its behavior during the draw and the shot.

Draw:

During the draw (see FIG. 2), the draw point $P_T$ on the string 10, on which the hand force $F_T$ is exerted, is displaced along a line of alignment between the draw point $P_T$ itself and the center C of contact between the hand and the grip 2. The corresponding point at the lower section of the string 10 must be displaced along the same line. Thanks to the flexibility of the lower limb 4*b*, the point at which the lower section of the string 10 is attached to the tip 4*bd* of the limb 4*b* rotates, though with variable radiuses, about the fulcrum C represented by the center of contact between the hand and the grip 2: therefore, the bow itself must rotate about such fulcrum C. Hence, the lower portion of the bow is displaced towards the archer, while the upper portion of the riser 1, with the base 4*ap* of the limb 4*a* articulated therein, is displaced away from him/her. To conform such motion, the upper limb 4*a* is forced to deflect, thereby accumulating energy, and to rotate against the receptacle 5, as its end 4*ad* is connected, to the draw point $P_D$ through the upper section of the string 10.

Shot:

The shot starts at the let-off. The vector $\vec{F_D}$ corresponding to the let-off, aligned with the line connecting the draw point $P_D$ and the fulcrum on the grip 2 is suddenly displaced and becomes a "propulsive" vector $\vec{Fp}$ aligned along the line connecting the nock of the arrow 13 and the center of gravity of the arrow 13, and hence with the mass axis in the arrow 13. At the same time, the mass of the limb 4*a* rotates forwards with respect to the riser, thereby causing the latter to rotate in an opposite direction, to maintain the position of the center of gravity of the system with respect to the fulcrum C. Furthermore, the "propulsive" vector $\vec{Fp}$, which acts along a line that does not pass through the fulcrum C, produces an equal and opposite reaction, which generates an instantaneous momentum L=Fp·d, where d is the instantaneous distance between the center-of-mass axis of the arrow 13 and the fulcrum C, and hence an angular momentum on the bow and the arrow 13 about the fulcrum C.

Such momentum L, which depends on energy changes as shown in the draw force curve DC, after subtraction of hysteresis losses during the shot and on the distributions of these energy changes into various kinetic energies of the moving components that can be determined from the geometry of the bow, is variable during the shot and is always proportional to the mass of the arrow 13. It causes an angular acceleration of the bow about the fulcrum C, which is proportional to the inverse of its moment of inertia $\alpha=L/I$ where $I=\Sigma dmr_i^2$, which is also variable during the shot (the center of gravity of two limbs 4*a* and 4*b* and the arrow 13 is displaced with respect to the fulcrum).

Double integration of angular acceleration in time provides the amplitude of rotation of the bow, which rotates opposite to the rotation direction it followed during the draw, to its initial angular position.

Accurate calculation of such rotation, considering all interdependent variables, in combination with the use of static cams 14 as set out in claim 7, allows controlled rotation of the bow during the shot, thereby providing a substantially rectilinear initial path, and limiting most parasitic dynamic components which, besides generating energy-dissipating vibrations in the bow and the arrow 13, would tend to cause spinning of the arrow 13. Such controlled rotation may be obtained by risers having small moments of inertia $\Sigma dmr^2$.

This feature may be obtained using hollow structures made from light-weight composite materials, such as carbon fiber/epoxy composites.

Another phenomenon that is useful for shooting performance occurs at the end of the shooting stroke, when, as the string 10 goes under tension, it tends to eliminate the difference between the moments generated by the difference of the forces of the string 10 along its two sections with respect to the fulcrum. The forces ff induced on the auxiliary cables 7 which are only present on the limb 4*a* generate a moment with respect to the fulcrum, due to the independent moving masses of the riser with the limb 4*b* and the arrow 13 with respect to the oppositely moving mass of the limb 4*a*, which brakes bow rotation while transferring some of the residual kinetic energy of bow rotation ($/\mathbf{1};\mathbf{2}\Sigma dmr^2\omega^2$) to the arrow 13.

Further Embodiments of the Bow, in which Both Limbs Deflect

The bows (see FIGS. 9, 10, 11) in which both limbs 4*a* deflect and rotate against a receptacle 5 do not exhibit the asymmetry conditions of the bow with only one deflecting limb 4*a*.

The quasi symmetry (the arrow 13 does not lie in the draw axis) in the statics and dynamics of the two limbs 4*a* with respect to the axis of the fulcrum (C) perpendicular to the plane (x, y) during the draw, and during the shot, allows the bow to have the same behavior as traditional compound bows.

These bows require a synchronizer to cause deflection and rotation motions to occur symmetrically and simultaneously.

Since the two deflecting limbs 4*a* behave like the limb 4*a* of the bow having one limb 4*a* of this type, the applications of the various synchronizing devices as claimed in claims 12, 13, 14, 15 and 16 will be only described below. A first embodiment (see FIGS. 9 and 9*p*) of the synchronized bow uses a synchronizer as set out in claim 13. In this synchronizer, a single auxiliary cable 7 for each pulley 23 is wound in a groove 24 thereof, in which it is secured in a point that is diametrically opposite to the position of the tip 4*ad* connected thereto. The two ends of the cable 7 are attached to the tip 4*ad* by two loops inserted in the two outer grooves 21 of the cylinders 19 which cover by their slits 20 the tips 4*ad* or around rigid extensions 18. Each shaft 22 is integral both with the two pulleys 23 and with a connecting pulley 25. An inextensible cable 26 forming a figure-eight shape is stretched in the grooves of the two pulleys 25: it allows the pulleys 25 to rotate through equal amplitudes in opposite directions. The cable 26 with the two pulleys 25 may be also replaced by two pairs of bevel gears or equivalent gears, each secured on each of the two shafts 22 and connected by one shaft.

Operation

If the nock of the arrow 13 should be displaced perpendicular to the axis of either the draw path or the shot path, the two alignments of the auxiliary cables 7 between the tips 4*ad* of the two limbs 4*a* and the center of the shafts 22 would rotate in the same direction, and no equilibrium condition might be reached. Conversely, thanks to this synchronizing device, i.e. thanks to the cable 26 forming a figure-eight shape, and to the two pulleys 25 connected to such cable 25, which pulleys 25 are concentric and integral each with a pair of pulleys 23, the tips 4*ad* cover, in opposite directions, circular arcs of almost the same amplitude, having a radius equal to the distance between the tips 4*ad* and the center of the shafts 22. Now, since the sections of the string 10 have constant lengths, the nock shall always cover the same path.

In a variant of this device (see FIG. 9) each pulley 23 is replaced by two arms 23*b* of equal lengths, integral with the shaft 22. Two auxiliary cables 7 of equal lengths are attached to the ends of such two arms, perpendicular thereto. These cables 7 are fixed by their opposite end to the tip 4*ad* of the corresponding limb 4*a*, in the same manner as the device with the pulleys 23.

Another embodiment of the bow (see FIG. 10) uses a synchronizer as set out in claim 15.

In this synchronizer, the angle α° depends on the angular position of the arms 27. As the arms 27 rotate, the distance between the shaft 28 and the auxiliary cables 7 changes: the angle α° increases or decreases with such distance. This rotation is caused by the difference of the forces ff exerted along the auxiliary cables 7 corresponding to each limb 4*a*. When the resultant $\overrightarrow{fa}$ of the forces ff exerted on the auxiliary cables 7 of a limb 4*a* forms a smaller angle α°, it (fa) increases as compared with the resultant $\overrightarrow{fa}$ of the auxiliary cables 7 of the opposite limb 4*a*, as the angle α° of the latter necessarily increases.

Now, if the hand draw point $P_T$ or the nock of the arrow 13 tends to be displaced perpendicular to the axis of either the draw path or the shot path, the angle α° of the limb 4*a* opposite to the direction of deviation with respect to such path tends to decrease, causing an increase of the force $\overrightarrow{fa}$. Such increase causes the corresponding arms 27 to rotate, and the angle α° to increase again: at the same time, a larger moment is generated with respect to the fulcrum 28, which generates a higher force along the cable 30 attached to the arms 27 by the anchorages 31, which in turn creates an opposite larger momentum with respect to the fulcrum 28 so that the corresponding angle α° is decreased, thereby increasing the force $\overrightarrow{fa}$, which in turn causes a decrease of the corresponding force fb on the section of the string 10, thereby restoring equilibrium conditions when the components fb sin $\delta°_{up}$ and fb sin $\delta°_{low}$ of the two sections of the string 10 are equal.

A further variant of the bow (see FIGS. 11 and 11D) as set out in claim 15 and in claim 16 consists in that the shaft 28 is located in front of the anchorages 29, i.e. the arms 27 are subjected to a tensile force and not to a compressive force like in the case of claim 15. In this bow, the balancing mechanism, based on the variation of the angles α° is identical to that of the bow of claim 15.

A further embodiment of the bow, as claimed in claim 17 and shown in FIGS. 7 and 12, which may be considered a hybrid versions, uses one or two limbs 4*c* restrained at the ends of the riser 1, in which auxiliary cables 7 are used in the same positions as in the bows that use inserted or hold or fitted and articulated limbs 4*a*. These limbs 4*a* simultaneously deform by deflection and bending. The deflection force $F\vec{c}$ is generated by the synergy of the component along the vector $F\vec{c}$ of the force fa resulting from the forces ff exerted along the auxiliary cables 7 and the component along the vector of the total force fb, that is:

$$F\vec{c}=\text{total } fb \cos \beta°+fa \cos \alpha°$$

whereas the bending force at the fixation point of the secured limb is caused by the moment M generated by the difference between the components of the forces fb and fa orthogonal to $F\vec{c}$, that is:

$$M=(\text{total } fb \sin \beta°-fa \sin \alpha°)c$$

where c is the distance between the two tips 4*cd* and 4*cp* of the limb 4*c*.

This bow, which has two limbs 4*c* does not require the use of a synchronizer, although it has the same draw force curve DC as all the bows of this invention, provided that the resisting bending moment $M_l$ is sufficient, i.e. capable of opposing any differences between the moments of the forces exerted along the two sections of the string 10 with respect to the fulcrum C. It is apparent that the draw forces $F_D$ can never be equal to zero, due to the presence of $M_l$, and that the alignment of the resultants $\vec{fa}$ of the auxiliary cables 7 may even become negative, i.e. be situated beyond the plane a'x+b'y+d'=0 containing the axes of the anchorages 8 and the axis of the receptacle 5.

The performance of this bow with two restrained limbs 4*c* having auxiliary cables 7 is not very different from the performance of traditional compound bows. Performance is improved if this bow has one limb 4*c* (see FIG. 8) with auxiliary cables 7 and one limb 4*b* restrained, with a maximum moment of inertia ($l^4$) at its fixation point.

Crossbows

The bow concept of this invention also applies to crossbows. These novel crossbows have draw force curves DC like those of the crossbows having eccentric pulleys or cams.

However, such novel DCs are of particular interest because, assuming equal openings of the two limbs, they provide a 55% longer stroke, thereby affording, at full draw, a≈50% increased energy accumulation. Considering the tilt bow version (see FIG. 16), i.e. with one deflecting limb 4*a* and one secured, bending limb 4*b*, the result is even more surprising.

First Embodiment

This crossbow, as set out in claim 19, is composed of a stock 33, a butt 34, a stirrup 37, two limbs 36, a string 38, divided into two sections, stretched between the two ends 36*d* of the two limbs, two auxiliary cables 40 for each limb 36, four anchorages 41 for such cables 40, a slider 42 with two of the ends of the two sections of the string 38 being attached thereto, and a release device 35, as shown in FIG. 13.

The stock 33, which may have any section whatever, has a groove or slit 43 at its top, which is at least as long as the stroke along which a fin 15 or vertical stabilizer of the slider 42 runs.

A head 44 is attached to the stock 33 or formed in the stock 33, with two front parallel holes formed therein symmetrically to the plane (x,y), having a diameter of 5÷6 mm, and perpendicular to the plane (x,z) or the slightly inclined plane ax+bx+d=0, whose angle of inclination ϵ° is equal to the arc tangent of the ratio of the distance of the longitudinal dynamical center of the axes of the receptacles 39 from a plane by +d=0 containing the axis of the arrow 13, to the distance between two generic planes ax+d=0 perpendicular to (x,y) and containing the dynamic center of the anchorage points 41 and the string 38 to the release device 35 respectively. Two front holes 122 tightly receive two shafts 52, having two small pulleys 55 of about 15÷20 mm mounted at the ends of each shaft 52, to act as anchorages 41. Two further holes of about 15 mm, parallel to the former and also symmetric with respect to the plane (x,y) are formed in the rear portion of the head 44. The dynamic centers of the four holes lie on the same plane. The two latter holes, with the diameter of about 15 mm, ending with an aperture 9 between two generatrices separated by an angle of about 90°÷100°, act as receptacles 39 thanks to two antifriction bearings 6, for receiving two solid rotating cylinders 11 which are as long as the bases 36*p* of the limbs 36. These cylinders 11 have a rectangular or trapezoidal slit 12 for attachment of the bases 36*p*. The two auxiliary cables 40 of each limb 36 connect, by two loops, the two pulleys 55 of one shaft 52 to the tip 36*d* of the corresponding limb 36. The tips 36*d* are covered by solid cylinders 19 having a longitudinal rectangular or trapezoidal slit 20 and two pairs of grooves 21, two of which, i.e. the external grooves, receive two loops of the cables 40, i.e. the loops opposite the ones in the pulleys 55. The two internal grooves 21 of these cylinders 19 receive two loops of one of the two sections of the strings 38. The opposite ends of the two sections are secured to two pins 16 integral with the two sides of the slider 42.

This crossbow has the same static draw and dynamic shot features as the bow described above.

The slider 42 of this crossbow acts as a synchronizer, as it prevents any side deviation of the sections of the string 38 on the plane by +d=0 of the arrow 13. The mass of such slider 42 reduces the acceleration of the arrow 13, although this drawback is compensated for by the absence of any pulley or cam at the tips of the limbs 36, as well as by a longer stroke.

The use of four cams 14 having identical geometric and construction features further improves the draw force curve DC in terms of energy accumulation and has actually no effect on shooting dynamics. In the crossbow, thanks to the presence of a limit stop for the slider, there is no need to provide limit stop supports 17.

Second Embodiment

This crossbow is structurally identical to the one described above, only differing therefrom in that the two limbs, which are like those of the bow as set out in claim 17, are not inserted or hold or fitted and articulated or hinged in the receptacles 39, but are both restrained to the front end of the stock by fixation techniques commonly used in traditional crossbows. However, each tip 36*d* of these limbs 36*d* is still connected by auxiliary cables 40 to corresponding anchorages 39 whose geometric and construction features are the same as those of the crossbow of the first embodiment.

The orthogonal sections of the limbs 36*b* are variable as those of the bow as set out in claim 18.

In this case, the two bending moments $M_l$ at the fixation point of the limbs 36*b* allow synchronous deflection and bending of the two limbs 36*b*.

The shortcoming of this crossbow is a shorter stroke, as compared with the first embodiment, resulting in a reduced energy accumulation capacity.

Third Embodiment

This variant of the crossbow (see FIG. 14) utilizes the advantages of the bow with one deflecting limb 36*a* having auxiliary cables 40, and one restrained limb 36*b* having a maximum moment of inertia $l^4$ at its fixation point.

The bow of the crossbow is obviously more powerful to reach usual crossbow draw forces and shorter to comply with usual maximum sizes.

In addition to a stock 33 with a butt 34, a release device 35, a stirrup 35 and a track or groove 43, this crossbow comprises a complete bow, coplanar to the plane (x,y) of symmetry of the crossbow, which is composed of:

a) a riser 1 having a minimized size, which is articulated to the front end of the stock 33 about an axis 45 perpendicular to the plane (x,y) of the crossbow, by means of one or two coaxial pins fixed above the shooting axis of the bolt 13. Such pin/s are fixed in the front portion of two parallel plates 58, made of one piece and secured to the two front sides of the stock 33. These plates 58 may be either locked in the desired position, i.e. the position determined for the axis 45 or may rotate about a pin 54 and be locked by two screws in two apertures 60 having the shape of a circular arc with the center of rotation about the pin 54. The riser 1 further has a window 56 for aiming, which is located between the axis of the bolt 13 and the fixation point of the limb 36, as well as a head containing the receptacle 39 and the anchorages 41 for the cables 40, having the same geometric and construction features as the bow as set out in claims 1 and next.

b) A limb 36*b* restrained in the upper end opposite to that with the head.

c) A limb 36*a* articulated in the head with the receptacle 39 and the anchorages 41, disposed in the lower end of the riser 1.

d) Two auxiliary cables 40 disposed on each side of such limb 36*a*, which are fixed both to its tip 36*ad*, in two grooves 21 of the cylinder 19, and to two anchorages 41.

e) Optionally, two cams 14 provided in the same positions and with the same arrangements and functions as those set out in claim 7.

f) A string 38 secured to the two tips 36 and 36*bd*, which can slide in a vertical through slot 46 formed in the stock 33 along the drawing and shooting stroke, whose center plane coincides with the plane of symmetry (x,y) of the crossbow.

g) a slider 42, formed of a vertical flat rigid body 15 precisely sliding in the slot 46, which has a rear attachment device complementary to the release device 35, and two fins 51 orthogonal to such body, precisely sliding in two coplanar slits, orthogonal to the slot 46 and disposed on each side of the plane (x,y). This slider is complemented by two pins 16 adapted to receive the two loops of the two sections of the string 38 or three pins 16 for locking the string 38. This slider may be replaced by the slider as set out in claim 23 (see FIG. 14*f*).

KEY

1) Riser;
2) Grip;
3) Arrow rest;
4) Limbs;
4*a*) Deflecting limbs;
4*b*) Bending limbs;
4*ad*) Tip of limbs 4*a;*
4*ap*) Base of limbs 4*a;*
4*bb*) Tip of limbs 4*b;*
4*bb*) Point of fixation of limbs 4*b;*
4*c*) Deflecting and bending limbs;
4*cd*) Tip of limbs 4*c;*
4*cp*) Point of fixation of limbs 4*c;*
5) Receptacle;
6) Open hollow cylinder;
7) Auxiliary cables;
8) Anchorages for auxiliary cables on riser head;
9) Receptacle aperture in cylinder 6 and riser head;
10) String;
11) Solid cylinder for the base of deflecting limbs;
12) Slit in cylinder 11;
13) Arrow;
14) Static cams;
15) Vertical rigid structures of slider 42;
16) Pins for attaching sections of string 38 or diverting pins for string 38.
17) Limit stop supports for cables 7;
18) Rigid extensions on limbs 4*a*, 4*c* and 36;
19) Tip cylinder with slit 20 and grooves 21;
20) Longitudinal slit in cylinder 19;
21) Annular grooves in cylinder 19;
22) Shafts of synchronization devices;
23) Pulleys of a synchronization device;
24) Groove of pulley 23;
25) Grooved drive pulley for synchronization devices;
26) Drive cable in a figure-eight shape;
27) Balancing arms for synchronization devices;
28) Shafts of arms 27;
29) Anchorages for cables 7 on arms 27;
30) Drive cable or rod for synchronization devices;
31) Anchorages for arms 30 on arms 27;
33) Pair of drive bevel gears;
34) Crossbow stock;
34) Crossbow butt;
35) Release device;
36) Crossbow limbs;
36*a*) Deflecting crossbow limbs;
36*b*) Bending crossbow limbs;
36*ad*) Tip of limbs 36*a;*
36*ap*) Base of limbs 36*a;*
36*bd*) Tip of limbs 36*a;*
36*bp*) Point of fixation of limbs 36*a;*
37) Stirrup;
38) String or string sections of crossbows;
39) Crossbow receptacles;
40) Crossbow auxiliary cables;
41) Anchorages for auxiliary cables 40;
42) Crossbow slider;
43) Track;
44) Rigid structure of crossbow head;
45) Rotation axis of a crossbow riser;
46) Vertical slit in the crossbow stock;
47) Grip or gun with trigger and safety;
48) Grooved pulley of slider 42;
49) Slider detent;
50) Thrust block for arrow;
51) Horizontal fins of slider 42;
52) Shafts of anchors 41;
53) Riser head slit for auxiliary cables 77;
54) Pin for adjustment of plates 58;
55) Pulleys of shafts 52;
56) Crossbow sight window
57) Crossbow side grip;
58) Crossbow head plates;
59) Anchorages of slider for string sections 38;
60) Circular aperture for adjustment of plate 58;
61) Rear sight
77) Single auxiliary cable

The invention claimed is:

1. A crossbow comprising:

a rigid stock having a longitudinal track therein, a longitudinal groove being provided within the track;

a butt coupled to a proximal end portion of the stock;

two deflectable limbs having inner ends connected to a distal end portion of the stock;

a stirrup substantially extending from the distal end portion of the stock; and a string extending between outer ends of the two limbs; and one or two pairs of auxiliary cables, each of the one or two pairs connecting the outer end of one of the limbs to anchorages on the distal end portion of the stock.

2. The crossbow of claim 1, further comprising a slider having a thrust block for an arrow, wherein the thrust block is slidable in the longitudinal groove and is laterally constrained by the track, wherein the string has two portions connecting the slider to the outer ends of the limbs, and wherein the inner ends of the two limbs are coupled to the distal end portion of the stock in two receptacles disposed symmetrically therein.

3. The crossbow of claim 1, wherein the inner ends of the two limbs are coupled to the distal end portion of the stock in two receptacles disposed symmetrically on the stock, further comprising a synchronization device selected from the group consisting of:

two shafts each passing through the distal end of the stock, two pairs of pulleys each having a groove, each pair of the pulleys being symmetrically coupled to the distal end portion of the stock and mounted onto opposing ends of one of the shafts such to rotate therewith, one of the auxiliary cables running onto the groove of one of the pulleys without slipping therein, the one of the auxiliary cables having two ends each connected to the outer end of one of the limbs or to extensions thereof, two additional pulleys each having a groove and mounted onto one of the ends of the two shafts, and a closed drive cable disposed in the grooves of the two additional pulleys in a figure-eight shape, such to allow rotation of the two additional pulleys;

two shafts each passing through the distal end portion of the stock, two pairs of pulleys each having a groove, each pair of the pulleys being symmetrically coupled to the distal end portion of the stock and mounted onto opposing ends of one of the shafts such to rotate therewith, one of the auxiliary cables running onto the groove of one of the pulleys without slipping therein, the one of the auxiliary cables having two ends each connected to the outer end of one of the limbs or to extensions thereof, two additional pulleys each having a groove and mounted onto one of the ends of the two shafts, and two pairs of bevel gears connected to the two shafts and joined by a common shaft, such to cause rotation of the two pulleys in opposite directions; and two pairs of arms, each pair of arms being symmetrically coupled to the distal end portion of the stock and interconnected by a rotatable shaft, and a cable or a rod connecting the two pairs of arms by being connected to two additional anchorages each provided on one of the arms.

4. The crossbow of claim 1, wherein the limbs are disposed in a plane that includes a longitudinal axis of a user, further comprising:

a riser articulated about an axis disposed transversally across plates forming the stirrup, the plates being substantially parallel to the limbs, the inner ends of the limbs being coupled to end portions of the riser, an aiming window being provided in an upper portion of the riser; and a side grip for holding the crossbow during a shot, wherein at least one of the limbs is coupled to a receptacle in the riser, wherein there is a single pair of the auxiliary cables secured to the anchorages, which are provided in the riser, and to the outer end of one of the limbs, and wherein the string is coupled to a slider slidable in a longitudinal groove defined in the longitudinal track, the slider comprising lateral fins slidable in mating slits in the longitudinal track.

5. The crossbow of claim 1, further comprising a slider having two side fins slidable within two lateral slits formed in the longitudinal track, a plurality of pins being provided in the slider for receiving the string therebetween, a thrust block for translating a crossbow bolt being formed in or attached to an upper portion of the slider.

6. A sport or hunting bow hawing a same draw force diagram as a compound bow and comprising:

a riser having a grip, a rest for an arrow, and two ends;

two resilient limbs each coupled to the riser; and a string secured directly to outer tips of the two limbs without means varying a force along the string when the string is drawn, wherein at least one of the limbs deforms elastically by pure deflection by rotating freely against a receptacle located on one of the two ends of the riser due to a resultant compressive force $\overrightarrow{FC}$, which is generated by synergy of a force $\overrightarrow{fb}$ exerted along the string being drawn and a force $\overrightarrow{fa}$ acting along an auxiliary cable secured, at a first end portion, directly to a tip of the at least one of the limbs, without means varying the three $\overrightarrow{fa}$ along the auxiliary cable, and further secured, at a second end portion, to the end of the riser where the receptacle lies, whereby static equilibrium of the forces $\overrightarrow{FC}$, $\overrightarrow{fa}$ and $\overrightarrow{fb}$, during draw is as follows:

$$\overrightarrow{FC} = \sqrt{\overrightarrow{fa}^2 + \overrightarrow{fb}^2 + 2 \cdot \overrightarrow{fa} \cdot \overrightarrow{fb} \cdot \cos(\alpha^\circ + \beta^\circ)}$$

where $\alpha^\circ$ is the angle between $\overrightarrow{fa}$ along the auxiliary cable and a line connecting the two ends of the deflecting limb along which $\overrightarrow{FC}$ is exerted, and where $\beta^\circ$ is the angle between a line connecting the two ends of the deflecting limb and the force $\overrightarrow{fb}$ along the string, such that:

$$\overrightarrow{fa} = \frac{\overrightarrow{FC} \cdot \sin\beta^\circ}{\sin(\alpha^\circ + \beta^\circ)} \text{ and } \overrightarrow{fb} = \frac{\overrightarrow{FC} \cdot \sin\alpha^\circ}{\sin(\alpha^\circ + \beta^\circ)},$$

whereby the two forces $\overrightarrow{fa}$ and $\overrightarrow{fb}$ are dependent upon a rotating angle position around the receptacle of the line connecting the two ends of the deflected limb.

7. The bow of claim 6, wherein one of the limbs is rigidly coupled to the other one of the two ends of the riser, the rigidly coupled limb being not connected to an auxiliary cable.

8. The bow of claim 6, wherein the thickness of the at least one of the limbs is thicker in a center portion of the at least one of the limbs and decreases towards extremities of the at least one of the limbs, and wherein the width of the at least one of the limbs is constant.

9. The bow of claim 6, wherein the at least one of the limbs is longitudinally split to provide two arms, and wherein the auxiliary cable is translatable within the two arms.

10. The bow of claim 6, wherein the receptacle comprises a hollow cylinder having a longitudinal aperture, the hollow cylinder being disposed in a housing formed at the one of the two ends of the riser, and wherein a solid cylinder is coaxially disposed within the hollow cylinder, the solid cylinder having a longitudinal groove in which the a base of the at least one of the limbs is disposed.

11. The bow of claim 6, further comprising a pair of stationary cams disposed symmetrically on opposing sides of the one of the ends of the riser, an outer portion of each of the stationary cams having a groove configured to receive the auxiliary cable as the at least one of the limbs deflects.

12. The bow of claim 11, wherein the auxiliary cable has end loops coupled to the at least one of the limbs, a center portion of the auxiliary cable being disposed within the grooves of the stationary cams and encircling in a single turn at least a part of the riser within a special groove formed therein.

13. The bow of claim 11, wherein each of the stationary cams comprises a support receiving one of the auxiliary cable upon translation thereof, the support being provided such to intercept the auxiliary cable, thereby preventing the auxiliary cable from translating beyond a longitudinal axis of the receptacle.

14. The bow of claim 6, wherein the second end portion of the at least one of the limbs comprises symmetric outward extensions configured to be encircled by one or more loops at ends of the string or at an end of the auxiliary cable.

15. The bow of claim 6, wherein the at least one of the limbs is secured within a longitudinal slit of a solid cylinder, and wherein the solid cylinder has two pairs of annular grooves disposed transversally at outer ends of the solid cylinder for receiving loops of the string and of the auxiliary cable.

16. The bow as claimed in claim 6, wherein both of the limbs are configured to have synchronized movements by having both of the limbs configured to be simultaneously subjected to equal deflections and covering equal articulation amplitudes.

17. The bow of claim 16, further comprising a synchronization device having:

two shafts respectively passing through ends of the riser;

two pairs of pulleys, each of the pulleys having a groove, each pair of the pulleys being symmetrically coupled to the ends of the riser and mounted onto opposing ends of one of the shafts such to rotate therewith;

the auxiliary cable running onto the groove of one of the pulleys without slipping therein, the auxiliary cable having two ends each connected to the one of the ends of the limbs or to extensions thereof;

two additional pulleys, each of the additional pulleys having a groove and being mounted onto one of the ends of the two shafts; and a closed drive cable disposed in the grooves of the two additional pulleys in a figure-eight shape, such to allow rotation of the two additional pulleys.

18. The bow of claim 16, further comprising a synchronization device having:

two shafts respectively passing through the ends of the riser;

two pairs of pulleys, each of pulleys having a groove, each pair of the pulleys being symmetrically coupled to ends of the riser and mounted onto opposing ends of one of the shafts such to rotate therewith;

the auxiliary cable running onto the groove of one of the pulleys without slipping therein, the auxiliary cable having two ends each connected to a second end of one of the limbs or to extensions thereof;

two additional pulleys, each of the additional pulleys having a groove and being mounted onto one of the ends of the two shafts; and two pairs of bevel gears connected to the two shafts and joined by a common shaft, such to cause rotation of the two pulleys in opposite directions.

19. The bow of claim 16, further comprising a synchronization device having:

two pairs of arms, each pair of arms being symmetrically coupled to the ends of the riser and interconnected by a rotatable shaft; and a cable or a rod connecting the two pairs of arms by being connected to two anchorages, each of the two anchorages being provided on one of the arms at opposing ends of the riser.

20. The bow of claim 19, wherein the rotatable shaft is coupled to the riser closer to a central portion of the riser than the receptacle.

21. The bow of claim 19, wherein at least one of the limbs deforms elastically by having a base fixed, fitted or restrained to the second end portion of the riser.

22. The bow of claim 21, wherein the limbs are configured to have a higher second order moments of inertia in the center portion of the limbs, the second moment of inertia decreasing toward ends of the limbs.

23. The bow of claim 6, wherein, if one of the resilient limbs is not connected to an auxiliary cable, that limb is simply fixed or restrained, and not articulated or hinged, in one of the two ends of the riser which is opposite to the end where the deflecting limb is articulated or hinged, and bends only under action of the string.

* * * * *